US006690253B1

(12) United States Patent
Precure

(10) Patent No.: US 6,690,253 B1
(45) Date of Patent: Feb. 10, 2004

(54) PRECURE MAGNETIC SWITCH

(76) Inventor: Carroll Ray Precure, Rte. 1, Box 1005, Muleshoe, TX (US) 79347

( * ) Notice: Subject to any disclaimer, the term of this patent is extended or adjusted under 35 U.S.C. 154(b) by 31 days.

(21) Appl. No.: 09/933,426

(22) Filed: Aug. 20, 2001

Related U.S. Application Data

(60) Provisional application No. 60/226,922, filed on Aug. 22, 2001.

(51) Int. Cl.[7] ..... H01H 9/00
(52) U.S. Cl. ..... 335/205
(58) Field of Search ..... 335/205, 206, 335/207

(56) References Cited

U.S. PATENT DOCUMENTS 3,760,312 A * 9/1973 Shlesinger, Jr. ..... 335/205
4,481,389 A * 11/1984 Johnson ..... 200/84 C
5,422,616 A * 6/1995 Jackman ..... 335/205

FOREIGN PATENT DOCUMENTS

JP 02056820 A * 2/1990 ..... H01H/36/00

* cited by examiner

*Primary Examiner*—Michael Friedhofer
*Assistant Examiner*—Bernard Rojas

(57) ABSTRACT

A magnetic switching device having a shaft with a permanent magnet and contact affixed, rotating between two stationary contacts, thereby providing two electrical circuits. All afore mentioned components being sealed within a plastic housing.

1 Claim, 3 Drawing Sheets

Fig # 1 - Terminal End
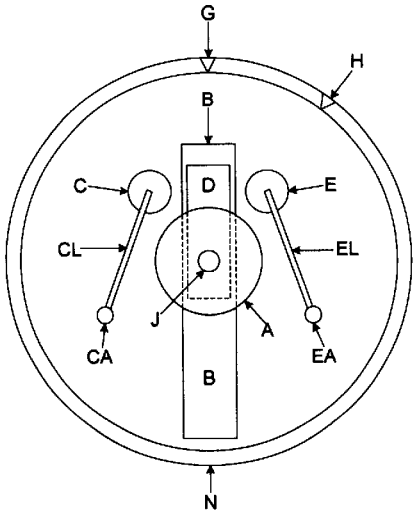
Fig # 2
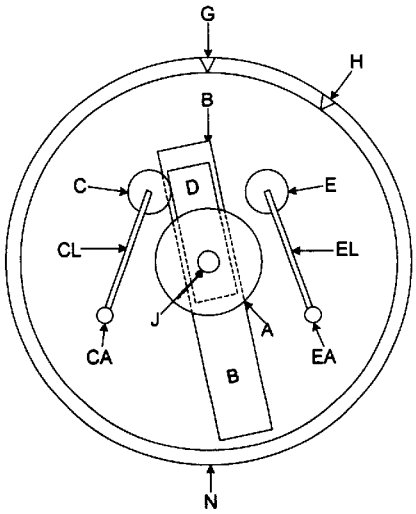
Fig # 5
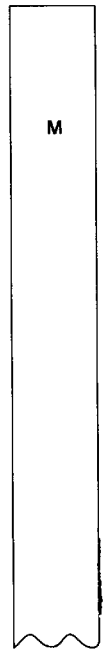

Fig # 3
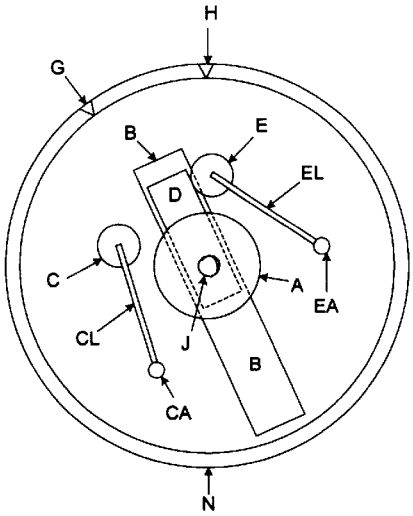
Fig # 6
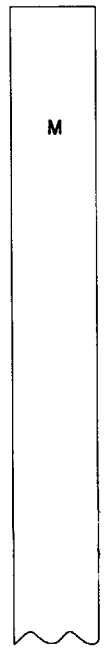
Fig # 4
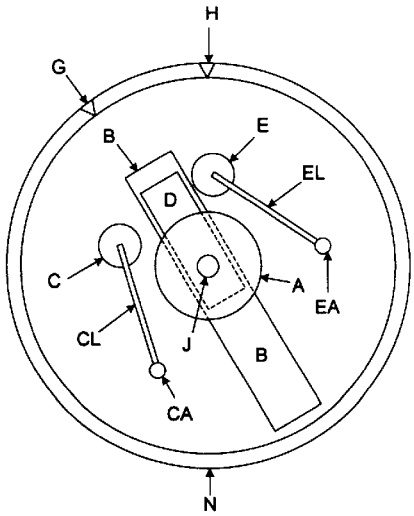

Fig # 7
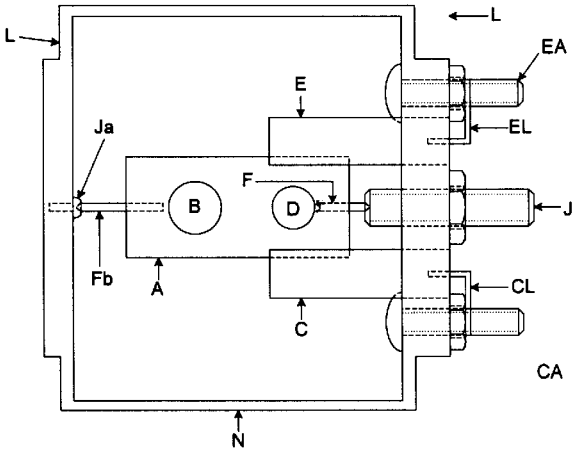
Fig # 8
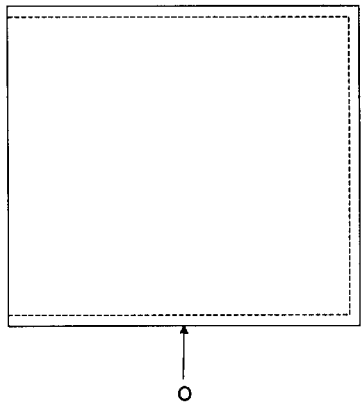

PRECURE MAGNETIC SWITCH

This application claims the benefit of Provisional Application No. 60/226,922 filed Aug. 22, 2001.

DETAILED DESCRIPTION OF THE DRAWINGS

The "Precure Magnetic Switch" is of the proximity type because it is actuated by an unconnected remote source. Either by ferreous metal or by magnetic material.

Said switch functions by gravitational pull and magnetic force.

The switch housing (N) and (L) are one piece. Injection molded from black ABS ultraviolet resistant plastic. The other housing part (not shown) is a half circle cover from the same material. The weather proof terminal cap (O) being the last part made from this material.

The non-conducting shaft (A) is made from ordinary injection molding plastic.

Magnet (B), 0.375" O.D.×2.000" rod is made from cobalt.

Contacts (C), (D), and (E) are made from carbon with 1.625 braided copper leads (CL) and (EL) attached.

Axles (F) and (Fb) are from 0.125 brass rod machined to approximately a 60 point on one end approx. 0.375" long.

Brass bearing and conductor (J) is a 0.250"×1.375" threaded brass rod, locked in place with a 0.250 brass lock nut. (J) is counter sunk on one end approx. 70 degrees to receive axle (F). (J) also serves as a "Take-up" to remove slack between bearings and axles.

Bearing (Ja) is a 0.125 dia. round head brass rivet with its head counter sunk approx. 70 degrees to receive axle (Fb).

(EA) and (CA) are #10 brass machine round head screws with lock nuts. These serve as terminals and connectors for contact leads (CL) and (EL).

The "Precure Magnetic Switch" is shown in FIG. 1 with the switch housing (N) in normally open circuit mode with indicator point (G) in the vertical position. The longer portion of magnet (B) being heavier holds moveable contact (D) equidistant from fixed contacts (C) and (E).

In FIG. 2, as the switch is moved adjacent to permanent bar magnet (M), FIG. 5, the rod magnet (B) is drawn to field magnet (M) thereby rotating shaft (A) counter clockwise causing moveable contact (D) to come against fixed contact (C) thus completing the circuit.

Conversely by rotating magnet (M), FIG. 5 180 degrees to reverse polarity, magnet (B) is pushed from magnet (M) thereby rotating shaft (A) clockwise to complete the circuit between (D) and (E).

The switch is illustrated in FIG. 3 with the switch housing (N) having been rotated counter clockwise around it's axis until indicator (H) is in the vertical position. The heavier portion of magnet (B) is holding moveable contact (D) against fixed contact (E) for the normally closed circuit operation.

In FIG. 4, as the switch is moved adjacent to field magnet (M), FIG. 6, magnet (B) is pulled, rotating shaft (A) counter clockwise to break circuit between moveable contact (D) and fixed contact (E).

FIG. 7 clarifies the location of magnet (B) relative to position of moveable contact (D). 7 also illustrates how axles (F) and (Fb) are installed into shaft (A) and into bearings (J) and (Ja).

Also in FIG. 7, we see how the electrical current is passed through bearing (J) (now serving as the common terminal), to axle (F), to moveable contact (D). Shaft (A) insulates parts (B), (Fb), and (Ja) from the electrical current.

FIG. 8 illustrates terminal cover (O), being a cylinder with one end open which fits over the terminal end housing (L) shown in FIG. 7.

BACKGROUND OF THE INVENTION

Historically many methods of controlling electrical currents have been used. It has been found that Using magnets to open and close circuits is among the simplest of the systems. Shlesinger, (U.S. Pat. No. 3,760,312) uses a powered rotating permanent magnet. This is one solution to timed circuit actuation. Paulet, (U.S. Pat. No. 4,199,741) provided a solution to the high driving torque of rotary switches. Lerner et. al. (U.S. Pat. No. 4,353,049) gives us a magnetic detent system instead of the old spring and ball. Johnson, (U.S. Pat. No. 4,481,389) furnishes an excellent magnetic control device utilising a closely adjacent actuating permanent magnet.

In some fields, such as in the motion and position control of "Center Pivot" irrigation machines there is a need for a sensitive non mechanical, non manual, non powered method of circuit control. A system whereby "switching" can be controlled by utilising a permanent magnet from a greater distance than before. The invention has made a substantial advancement in this area.

Center pivot irrigation is a well-known and widely used method of applying water on cropland.

There are several methods of controlling the operation of these systems. Controlling is the method of halting or reversing the rotation of the outer end of the pivot system at a given point in the cropland.

METHOD #1

No automatic control. The system moves in either clockwise or counter clockwise mode.

The operator must be at "the right place at the right time." Day or night. To shut down or reverse the system.

METHOD #2

A micro switch mounted at the pivot leg. Activated by adjustable trigger located on the pivot ring.

This allows the operator to stop or reverse the system by moving the trigger to the imaginary compass point on the ring relative to the stopping or reverse point of the outer end of the machine.

However with this method the outer end of the system never stops or reverses at the same point.

Due to frictional differences in changing soil conditions, the drive wheels on the end tower will loose or gain traction. This will cause the end tower to loose or gain distance relative to the given stop or reverse point of the outer end. This can affect accuracy by 20 to 50 feet.

METHOD #3

Computer controlled at the pivot. This system was developed around 1988. But has fallen out of favor due to being a serviceman's nightmare. And to being initially expensive to install. Also the control module is very expensive and subject to burn out by lightning.

METHOD #4

The moveable barrier method involves mounting four micro-switches at the center of the end tower.

These switches are actuated mechanically by two three-foot long hanging trigger arms. These in turn move a rod fore and or aft. Said rod is attached to a cam, which operates the micro switches.

This method of control necessitates the placing of portable trigger points in the field. They are called barriers. The barriers are usually made from 1½" "or 2"" steel pipe. They are constructed in an "L" shape and weigh as much as one hundred fifty pounds.

The longer and heavier of the L's leg is placed horizontally on the ground directly in the path and with it's end against the movement of the end tower's drive wheels.

As the end tower arrives at the barrier. The drive wheel rolls upon the horizontal leg. Thereby holding the barrier steady as the trigger arm pushes against the vertical leg of the barrier.

This method is complicated and expensive to build and install. Moving the barriers is difficult and cumbersome. Especially after the weight of the end tower has buried the horizontal leg into the mud.

And if the crop is of a tall nature as is corn. The hanging trigger arms can foul in the stalks, causing the system to prematurely stop or reverse.

IF the switches fail to function the end tower usually rolls up on the barrier. This can cause the end tower to up end. Resulting in great expense in repairs and down time.

SUMMARY OF THE INVENTION

An electrical switch having a contact and permanent magnet affixed to a rotating shaft mounted on an axis between two stationary contacts. Whose radii corresponds with that of the shaft mounted contact. Whose rotation responds to the polarity of a remote adjacent permanent bar magnet, causing the rotating shaft mounted contact to meet, or leave one or the other stationary contacts to complete or break the circuit. All the above described parts (excepting the remote permanent bar magnet) encased within a non conductive plastic housing.

BRIEF DESCRIPTION OF THE DRAWINGS

FIG. 1 showes switch from terminal end with all internal parts illustrated. Heavy end of magnet (B) is holding contact (D) in the normally open mode.

FIG. 5 illustrates permanent bar magnet (M) being placed adjacent to switch, FIG. 2, (M) has pulled maget (B) to close circuit between contacts (D) and (C).

FIG. 3 illustrates switch from terminal end. Housing (N) has been rotated counter clockwise thereby bringing contact (E) against contact (D) to close that circuit.

FIG. 6 illustrates permanent bar magnet (M) placed adjacent to switch FIG. 4. (M) has pulled magnet (B) to open circuit between contacts (D) and (E).

FIG. 7 shows switch with top half removed to reveal a more clarified view of internal parts. And the route of the electrical current through terminal (J) through axle (F) to contact (D).

FIG. 8 is a view of the terminal end cover. Which obviously fits over the flange molded to the terminal end housing (L) of the switch (FIG. 7).

PARTS LEGEND

A—shaft

B—cylindrical magnet

C—fixed contact

CA—fixed contact "C" terminal

CL—fixed contact "C" lead

D—moveable shaft contact

E—fixed contact

EA—fixed contact "E" terminal

EL—fixed contact "E" lead

F—axle and conductor

Fb—axle, non-conductor

G—normally-open indicator

H—normally-closed indicator

J—brass bearing and conductor

Ja—brass bearing non-conductor

L—end, switch housing

M—field magnet

N—switch housing

O—terminal end cap

I claim:

1. A magnetic switching device for a single machine or multiple machines actuated by a remote permanent bar magnet(s), a housing containing a shaft comprised of a pivotally mounted cylindrical permanent magnet, a carbon contact affixed at a right angle through the shaft, a moveable contact placed into the shaft at a right angle and adjacent to the magnet, wherein the direction of the shaft's rotation is determined by the polarity and position of the remote bar magnet(s), resulting in switching between said moveable contact and either of said fixed contacts being opened or closed when the switching device is adjacent to the remote bar magnet, wherein the shaft is supported by bearing points affixed to each end of said housing, one of the bearing points acts as the common electrical terminal of said switching device, one end of the housing has affixed two carbon contacts with one contact positioned on each side of the shaft mounted moveable contact; and wherein the switching device is mounted on the machine(s) whose motion is in a fixed track, said machine(s) having its start, forward and reverse modes determined by the polarity and positioning of the remote permanent bar magnet(s).

* * * * *